US012642336B2

(12) United States Patent
Napoli et al.

(10) Patent No.: US 12,642,336 B2
(45) Date of Patent: Jun. 2, 2026

(54) BRACELET STRAND WITH OPTICAL EFFECT

(71) Applicant: The Swatch Group Research and Development Ltd, Marin (CH)

(72) Inventors: Sophie Napoli, Neuchatel (CH); Nicolas François, Neuchatel (CH); Marek Dovcik, Mougins (FR)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 18/314,263

(22) Filed: May 9, 2023

(65) Prior Publication Data

US 2024/0122312 A1 Apr. 18, 2024

(30) Foreign Application Priority Data

Oct. 13, 2022 (EP) ..... 22201281

(51) Int. Cl.
*A44C 5/00* (2006.01)

(52) U.S. Cl.
CPC ..... *A44C 5/0007* (2013.01)

(58) Field of Classification Search
CPC ..... A44C 5/0046; A44C 5/00; A44C 5/0007; G04B 37/1486; G04B 37/1493; G04B 37/18; Y10T 24/4782
USPC ..... 224/164, 165, 173
See application file for complete search history.

(56) References Cited

U.S. PATENT DOCUMENTS 1,055,579 A * 3/1913 Wachter ..... A44C 5/0053 63/3
1,827,695 A * 10/1931 Welch ..... A44C 17/007 63/31
1,850,190 A * 3/1932 Welch ..... A44C 25/002 63/31
1,912,602 A * 6/1933 Stonberg ..... A44C 17/006 63/31

(Continued)

FOREIGN PATENT DOCUMENTS

CH 713234 A2 * 6/2018
EP 373806 A2 * 6/1990

(Continued)

OTHER PUBLICATIONS

Japanese Notice of Reasons for Refusal issued Apr. 9, 2024 in Japanese Patent Application No. 2023-080667 (with unedited computer-generated English Translation), 10 pages.

(Continued)

*Primary Examiner* — Jason W San
*Assistant Examiner* — Anna S Rashid
(74) *Attorney, Agent, or Firm* — Oblon, McClelland, Maier & Neustadt, L.L.P.

(57) ABSTRACT

The invention relates to a bracelet strand made of a transparent or translucent elastomer material, comprising a first end capable of connecting to a watch case, characterised in that it comprises a rigid insert having a solid part forming a reinforcement, and a hollow part arranged to receive a fluid and solid elements dispersed in the fluid, said hollow part being located at the centre of the solid part, and in that the insert is coated in the transparent elastomer, and is positioned at the first end capable of connecting to a watch case.

10 Claims, 1 Drawing Sheet

(56) References Cited

U.S. PATENT DOCUMENTS 2,749,634 A * 6/1956 Billett ..... A44C 5/0015 40/728
2,796,747 A * 6/1957 Ebert ..... A44C 5/003 63/3.1
2,827,309 A * 3/1958 Fred ..... A44C 5/0046 40/633
3,010,627 A * 11/1961 Hoover ..... A24F 19/0064 224/241
3,470,638 A * 10/1969 Mauch ..... G04B 47/003 40/107
3,521,798 A * 7/1970 Hill ..... A44C 5/0015 224/165
3,631,616 A * 1/1972 Hill ..... G09F 23/16 40/633
3,780,918 A * 12/1973 Curtis ..... A44C 5/003 206/5
3,864,856 A * 2/1975 McManus ..... G09F 3/005 968/398
3,971,206 A * 7/1976 Martino ..... G04C 10/00 368/282
3,977,176 A * 8/1976 Murakami ..... G04G 17/083 368/204
4,142,383 A * 3/1979 Eberhart ..... A44C 15/00 63/23
4,178,879 A * 12/1979 Cunningham ..... A01K 27/006 119/858
4,785,981 A * 11/1988 Rodman ..... A44C 5/003 63/19
4,906,025 A * 3/1990 Schreindl ..... B42D 5/006 224/267
5,006,375 A * 4/1991 Mangan ..... A47G 33/08 40/406
5,020,039 A * 5/1991 Yokote ..... G04C 3/001 368/204
D329,201 S * 9/1992 Barat ..... D10/2
5,601,222 A * 2/1997 Haddad ..... A44C 5/0007 359/810
5,769,290 A * 6/1998 Pestana ..... A44C 5/2071 224/178
5,802,014 A * 9/1998 Danko ..... A61J 7/0481 368/282
6,027,774 A * 2/2000 Fine ..... G09F 19/02 40/406
6,158,884 A * 12/2000 Lebby ..... H04B 1/385 368/204
6,308,443 B1 * 10/2001 Lin ..... G09F 19/08 40/406
6,455,140 B1 * 9/2002 Whitney ..... B44C 5/00 428/407
7,542,379 B2 * 6/2009 Kimel ..... G04B 47/00 368/10
8,125,853 B2 * 2/2012 Greubel ..... A44C 5/24 368/282
8,534,514 B2 * 9/2013 Zhu ..... G06F 1/163 224/267
8,869,556 B2 * 10/2014 Asscher ..... A44C 27/00 63/15
10,139,185 B2 * 11/2018 Jacobson ..... F41A 29/02
10,179,676 B1 * 1/2019 Taylor ..... B65D 55/165
10,241,351 B2 * 3/2019 Blum ..... G02C 11/10
10,670,888 B1 * 6/2020 Yang ..... G02C 11/10
10,761,346 B1 * 9/2020 Yang ..... G02B 27/0176
11,019,734 B1 * 5/2021 Davis ..... H10K 85/221
11,541,584 B1 * 1/2023 Quinonez ..... B29C 45/2738
11,805,863 B1 * 11/2023 Decker ..... A45C 13/1069
11,849,817 B2 * 12/2023 Reginelli ..... A44C 17/025
2001/0006492 A1 * 7/2001 Hirano ..... G04B 37/1493 368/281
2008/0173045 A1 * 7/2008 Turner ..... A44C 25/002 40/406
2008/0210722 A1 * 9/2008 Ishihara ..... A44C 5/14 224/164
2009/0173760 A1 * 7/2009 Good ..... A45F 5/00 368/282
2009/0197692 A1 * 8/2009 Eck ..... A63B 69/3608 473/409
2009/0260393 A1 * 10/2009 Robbins-Sullivan .... A44C 7/00 239/36
2010/0229596 A1 * 9/2010 Manning ..... A44C 25/005 63/1.14
2012/0036893 A1 * 2/2012 Forero ..... A44C 5/0015 63/3
2012/0118016 A1 * 5/2012 Maloney ..... A44C 9/0092 63/15.8
2013/0276479 A1 * 10/2013 Noyes ..... A44C 17/0283 29/896.41
2016/0066660 A1 * 3/2016 Pluemer ..... A44C 5/14 224/165
2018/0295953 A1 * 10/2018 Vouillamoz ..... A44C 5/0007
2019/0216185 A1 * 7/2019 Carpano ..... A44C 1/00
2021/0059362 A1 * 3/2021 Xue ..... G04G 17/08

FOREIGN PATENT DOCUMENTS

GB 2225703 A * 6/1990 ..... A44C 5/0053
JP 06038813 A * 2/1994
JP 200-41714 A 2/2000
JP 2000041714 A * 2/2000 ..... A44C 5/14

OTHER PUBLICATIONS

European Search Report issued Mar. 2, 2023 in European Application 22201281.7 filed on Oct. 13, 2022, 3 pages (with English Translation of Categories of Cited Documents).

* cited by examiner

BRACELET STRAND WITH OPTICAL EFFECT

CROSS-REFERENCE TO RELATED APPLICATIONS

This application claims the benefit of priority from prior European Application No. 22201281.7 filed Oct. 13, 2022.

TECHNICAL FIELD OF THE INVENTION

The invention relates to a watch bracelet with an optical effect.

The invention further relates to a method for producing a watch bracelet with an optical effect.

TECHNOLOGICAL BACKGROUND

Conventionally, watch bracelets are made of leather, a synthetic material, fabric, a rubber material or metal. The bracelets further comprise an insert disposed in a lining or sheath or between an upper strip and a lower strip which are subsequently joined together. This insert has a primarily mechanical and flexible function.

In the case of a rubber bracelet, an insert made of a mechanically strong, rigid material is commonly used. This insert can, in particular, be made by injection moulding using a thermoplastic material such as a polyamide either alone or filled with a filler (carbon fibres, glass fibres, etc.). Once the insert has been produced, it is placed in the mould and the rest of the rubber strand is overmoulded (by injection or compression) around it.

Today, optical or decorative effects can be added to the bracelet, but it is clear that the integration thereof is difficult in terms of ensuring sufficient protection against varying environmental conditions, impacts or abrasion while the watch is being worn.

Mention can be made in this respect of the European patent application No. 0 373 806, which describes a watch bracelet. The bracelet comprises a transparent plastic pouch filled with a liquid and with particles, the pouch being housed between a lower part and an upper part of the bracelet and being visible through an opening in the upper part. However, it does not provide sufficient protection for the pouch against environmental conditions and impacts or abrasion, which is a drawback. Moreover, the overall thickness of such a bracelet is often too great and the pouch remains visible, which also detracts from the aesthetics of the bracelet.

SUMMARY OF THE INVENTION

The purpose of the invention is in particular to overcome the various drawbacks of the bracelets of the prior art.

More specifically, one purpose of the invention is to provide a bracelet strand with an optical effect and having a controlled thickness while guaranteeing that the optical effect is well protected.

To this end, the invention relates to a bracelet strand made of an elastomer material, comprising a first end capable of connecting to a watch case, characterised in that it comprises a rigid insert having a solid part forming a reinforcement, and a hollow part arranged to receive a fluid and solid elements dispersed in the fluid, said hollow part being located at the centre of the solid part, and in that the insert is coated in a transparent elastomer forming the bracelet strand, said insert being positioned at the first end capable of connecting to a watch case.

According to other advantageous alternative embodiments of the invention:

- the particles have a higher density than the fluid;
- the fluid is selected from: an aqueous solution or a vegetable or mineral oil;
- the solid elements are selected from: 3D or 2D metal particles, phosphorescent particles or beads;
- the insert is made of a transparent polymer that is amorphous or that has a very low crystallinity;
- the insert has a mechanical strength with a Young's modulus greater than 1 GPa;
- the insert comprises a metal blade arranged such that it is in contact with a middle;
- the hollow part takes the form of a logo, a letter, a number or a pattern;
- the insert comprises two shells, each shell comprising a cavity forming the hollow part;
- the insert comprises a channel opening out into the hollow part so as to fill the latter.

The invention further relates to a method for manufacturing a bracelet strand in accordance with the invention, the method comprising the following steps of:

- taking a transparent insert comprising a hollow part;
- taking a fluid and adding solid elements thereto to form a solution with suspended particles;
- injecting the solution obtained into the insert via a channel opening out into the hollow part;
- closing the channel in a leak-tight manner;
- overmoulding a transparent or translucent elastomer material over the insert to form a bracelet strand, then vulcanising or "curing" the overmoulded material to obtain a flexible strand made of an elastomer material and comprising an insert with a hollow part such that the solution with the suspended particles is visible from outside the bracelet strand.

BRIEF DESCRIPTION OF THE FIGURES

Other features and advantages of the invention will become apparent upon reading the following detailed description given by way of a non-limiting example, and with reference to the accompanying drawings, in which.

DETAILED DESCRIPTION OF THE INVENTION

Figure 1:
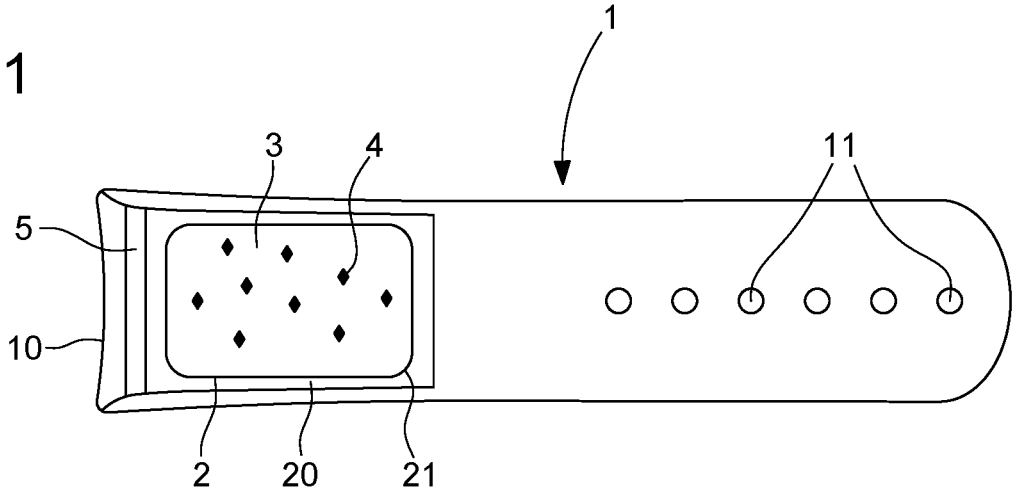
FIG. 1 shows a sectional view, along a median plane in the lengthwise direction, of a bracelet strand according to the invention.
Figure 2:
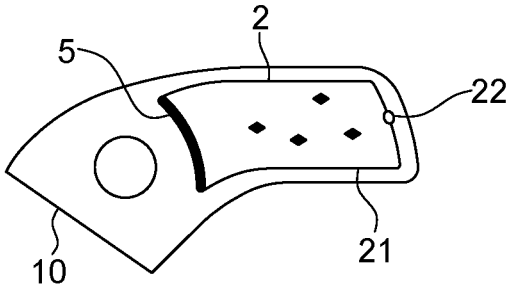
FIG. 2 shows a sectional view, along a median plane in the heightwise direction, of a bracelet strand according to the invention.
Figure 3:
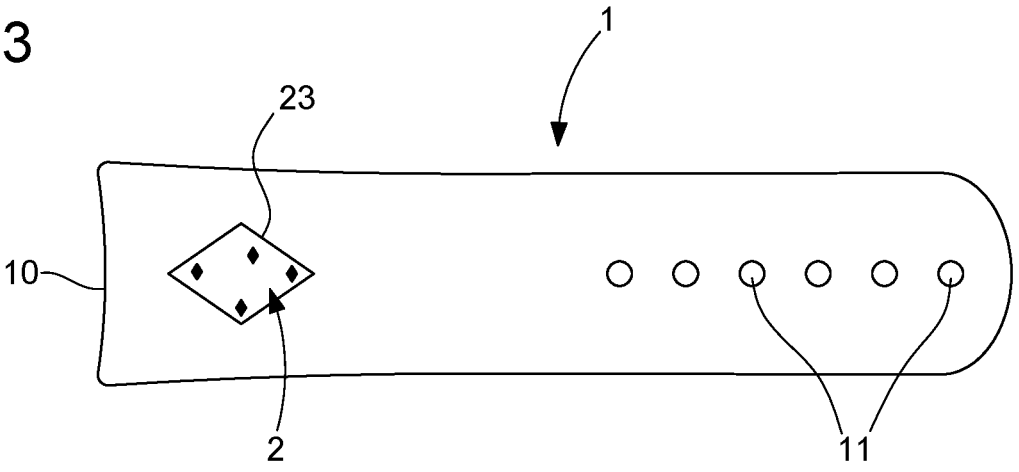
FIG. 3 shows a top view of a bracelet strand according to the invention.

Reference is made to FIG. 1 which shows one of the two flexible strands of a watch bracelet, which strands jointly form a watch bracelet and each carry an insert 2.

The watch bracelet strand 1 includes a first end 10 capable of receiving an attachment bar and of being attached to a watch case by means of this attachment bar. The bracelet strand 1 is pierced with holes 11 in succession of one another along a part of the length thereof, each of the holes 11 being provided to allow for the passage of a member of a buckle or a pin enabling the watch bracelet strand 1 to be attached to the other watch bracelet strand and thus close the watch bracelet, for example around a wrist.

The watch bracelet strand 1 takes the form of a flexible strip made of an elastomer material and comprises an insert 2 over which the strip made of a flexible material is moulded.

The elastomer forming the bracelet strand is elastically compressible and is not well suited for attachment to the watch case, and an insert 2 is thus integrated by overmoulding at the first end of the strand 1 which is intended to be connected to the watch case.

According to the invention, the first end 10 capable of connecting to a watch case comprises a rigid insert 2 forming a reinforcement and increasing the rigidity of the strand in the vicinity of the watch case.

The insert 2 comprises a solid part 20 and a hollow part 21 formed at the centre of the solid part and arranged to receive a fluid 3 as well as solid elements 4 dispersed in the fluid.

Advantageously, the solid elements 4 have a higher density than the liquid in which they are located in order to allow them to flow when the bracelet strand is set in motion or shaken.

The solid elements 4 are selected from: 2D or 3D metal particles, phosphorescent particles, microbeads, flakes or scales, etc.

The fluid 3 is selected from: water, or oil, etc. and can be colourless or coloured. It goes without saying that the fluid must be transparent or translucent in order to allow the solid elements to be visible.

According to a preferred embodiment of the invention, the insert 2 is coated in a transparent elastomer forming the bracelet strand 1 to allow the hollow part receiving the fluid and the solid elements dispersed in the fluid to be observed. The elastomer is intended to be transparent or translucent, and is made of cross-linked materials of the FKM or silicone type, but also of non-cross-linked materials of the thermoplastic elastomer type such as TPE-U or TPE-S.

According to the needs of the person skilled in the art, the hollow part 21 takes the form of a logo, a letter, a number or a pattern.

According to another embodiment of the invention, the insert 2 is coated in an opaque elastomer forming the bracelet strand 1, with the bracelet strand comprising an opening 23 or an area in which the material has been removed as far as the insert 2 to allow the hollow part receiving the fluid and the solid elements dispersed in the fluid to be observed.

According to yet another embodiment, the insert 2 has a logo, a letter, a number or a pattern formed in positive relief that is housed inside a corresponding opening in the bracelet strand and forms the hollow part of the insert.

This insert 2 is made of a non-compressible material such as a thermoplastic. In this example, the insert 2 takes the form of a parallelepipedal element. The insert thus makes the end connected to the watch case extremely rigid.

Advantageously, the insert is made of a transparent polymer that is amorphous or that has a low crystallinity of the PEF, PET, polycarbonate, polyamide or polymethyl methacrylate, epoxy or PUR type.

The insert is produced by moulding, 3D printing or machining.

The insert has a mechanical strength with a Young's modulus greater than 1 GPa so as to withstand the tensile/torsional/bending stresses of the bracelet during installation and use thereof.

According to one embodiment of the invention, the insert is reinforced with a metal blade 5 at the first end of the strand 1 which is intended to be connected to the watch case in order to give the bracelet a good tensile and tensile/torsional strength, with the metal blade 5 being arranged to be in contact with the watch case when the bracelet strand is attached thereto.

In order to be able to fill the hollow part of the insert 2, the latter comprises a channel 22 opening out into the hollow part in order to fill the latter, the mixture of fluid and solid elements being injected into the hollow part by means of a syringe for example.

The connection between the bracelet strand 1 and the insert 2 can be improved by means of an adhesive agent or mechanical hooking elements, and thus prevent the insert from becoming detached during overmoulding and the repeated bending of the bracelet strand during use. Various adhesive agents can be used depending on the material pair used.

According to a second embodiment of the invention, the insert takes the form of two shells arranged to be joined by means of a joint, a weld or an adhesive, each shell comprising a cavity forming the hollow part.

The invention further relates to a method for manufacturing a bracelet strand provided with an insert.

The method for manufacturing a bracelet strand comprises the following steps of:

a) taking a transparent insert comprising a hollow part;
b) taking a fluid and adding solid elements thereto to form a solution with suspended particles;
c) injecting the solution obtained into the insert via a channel opening out into the hollow part;
d) closing the channel in a leak-tight manner;
e) overmoulding a transparent or translucent elastomer material over the insert to form a bracelet strand, then vulcanising or "curing" the overmoulded material to obtain a flexible strand made of an elastomer material and comprising an insert with a hollow part such that the solution with the suspended particles is visible from outside the bracelet strand.

The invention further relates to a watch comprising at least one bracelet strand in accordance with the invention.

Thanks to these various aspects of the invention, the invention provides a bracelet strand with an optical effect and good mechanical strength.

It goes without saying that the present invention is not limited to the example shown and that various alternatives and modifications that may be apparent to a person skilled in the art can be made thereto, while still remaining within the scope of the invention as defined by the claims.

The invention claimed is:

1. A bracelet strand made of a transparent or translucent elastomer material, comprising:

a first end configured to connect to a watch case;

a rigid insert having a solid part forming a reinforcement;

a metal blade arranged along and reinforcing only one edge surface of the insert, the one edge surface positioned on a side of the insert that faces in a direction of the first end; and a hollow part arranged to receive a fluid and solid elements dispersed in the fluid, wherein said hollow part is positioned within the solid part and is located at a centre of the solid part, and wherein the insert is coated in the transparent elastomer and is positioned at the first end capable of connecting to a watch case.

2. The bracelet strand according to claim 1, wherein the particles have a higher density than the fluid.

3. The bracelet strand according to claim 1, wherein the fluid is selected from: an aqueous solution or a mineral or vegetable oil.

4. The bracelet strand according to claim 1, wherein the solid elements are selected from: metal particles, phosphorescent particles, beads, flakes or scales, etc.

5. The bracelet strand according to claim 1, wherein the insert is made of a transparent polymer that is amorphous or that has a very low crystallinity.

6. The bracelet strand according to claim 1, wherein the insert has a mechanical strength with a Young's modulus greater than 1 GPa.

7. The bracelet strand according to claim 1, wherein the hollow part takes the form of a logo, a letter, a number or a pattern.

8. The bracelet strand according to claim 1, wherein the insert comprises two shells, each shell comprising a cavity forming the hollow part.

9. The bracelet strand according to claim 1, wherein the insert comprises a channel opening out into the hollow part so as to fill the latter.

10. A method for manufacturing a bracelet strand according to claim 1, the method comprising:

a) taking a transparent insert comprising a hollow part, the insert including a rigid insert having a solid part forming a reinforcement;

b) taking a fluid and adding solid elements thereto to form a solution with suspended particles;

c) injecting the solution obtained into the insert via a channel opening out into the hollow part;

d) closing the channel in a leak-tight manner;

e) overmoulding a transparent or translucent elastomer material over the insert to form a bracelet strand, then vulcanising the overmoulded material to obtain a flexible strand made of an elastomer material and comprising an insert with a hollow part such that the solution with the suspended particles is visible from outside the bracelet strand, wherein the hollow part is positioned within the solid part and is located at a center of the solid part, and a metal blade arranged along and reinforcing only one edge surface of the insert, the one edge surface positioned on a side of the insert that faces in a direction of a first end of the bracelet strand that is configured to be connected to a watch case.

* * * * *